US010861395B2

(12) United States Patent
Moon et al.

(10) Patent No.: US 10,861,395 B2
(45) Date of Patent: Dec. 8, 2020

(54) DISPLAY DEVICE HAVING A SCAN DRIVER INCLUDING A PLURALITY OF STAGES AND SIGNAL LINES ARRANGED IN A STAIR PATTERN

(71) Applicant: LG Display Co., Ltd., Seoul (KR)

(72) Inventors: Sunji Moon, Paju-si (KR); Soonhwan Hong, Paju-si (KR); Juyun Lee, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/216,689

(22) Filed: Dec. 11, 2018

(65) Prior Publication Data

US 2019/0197962 A1 Jun. 27, 2019

(30) Foreign Application Priority Data

Dec. 27, 2017 (KR) ..... 10-2017-0181361

(51) Int. Cl.
*G09G 3/3266* (2016.01)

(52) U.S. Cl.
CPC ... *G09G 3/3266* (2013.01); *G09G 2300/0408* (2013.01); *G09G 2300/0426* (2013.01); *G09G 2310/0281* (2013.01); *G09G 2320/0223* (2013.01)

(58) Field of Classification Search
CPC ..... G09G 3/3266
USPC ..... 345/691
See application file for complete search history.

(56) References Cited

U.S. PATENT DOCUMENTS

2017/0061878 A1* 3/2017 Park ..... G09G 3/3233
2018/0006105 A1* 1/2018 Kim ..... G09G 3/3258
2018/0067356 A1* 3/2018 Katsuta ..... G02F 1/1345

FOREIGN PATENT DOCUMENTS

KR 10-2016-0082883 A 7/2016

* cited by examiner

*Primary Examiner* — Long D Pham
(74) *Attorney, Agent, or Firm* — Seed IP Law Group LLP

(57) ABSTRACT

The present disclosure provides a display device including a display panel and a scan driver. The display panel has a display area for displaying an image. A scan driver is arranged in a non-display area of the display panel, and includes circuits for generating scan signals and a scan driver having signal lines for transferring signals and voltages for driving the circuits. Each of the circuits is composed of a plurality of stages and disposed along the display area, and the signal lines are disposed outside the circuits.

8 Claims, 10 Drawing Sheets

DISPLAY DEVICE HAVING A SCAN DRIVER INCLUDING A PLURALITY OF STAGES AND SIGNAL LINES ARRANGED IN A STAIR PATTERN

CROSS-REFERENCE TO RELATED APPLICATION(S)

This application claims the benefit of Korean Patent Application No. 10-2017-0181361, filed on Dec. 27, 2017, which is incorporated herein by reference for all purposes as if fully set forth herein.

BACKGROUND

Technical Field

The present disclosure relates to a display device.

Description of the Related Art

With the development of information technologies, the market of displays used as a medium for connecting user and information is growing in size. Accordingly, displays based on display devices such as an Organic Light Emitting Display (OLED), a Quantum Dot Display (QDD), a Liquid Crystal Display (LCD), and a Plasma Display Panel (PDP), are used more widely.

The aforementioned display includes a display panel including a plurality of subpixels, a driver configured to output a driving signal for driving the display panel, and a power supply configured to generate power to be supplied to the driver.

A display device may be made in a small size, a medium size, or a large size. According to a size or a shape of the display device or an application, configuration of the display panel, a driving device (including a peripheral device) connected to the display panel, and a structure accommodating the display panel and the driving device may vary.

The purpose and the use environment of a display device are changing variously. Accordingly, even a display panel for displaying an image takes various shapes including the traditional quadrangular and rectangular shape, a curved shape, and a circular shape.

Meanwhile, a differentiated display device including a circular or elliptical shaped display panel has an advantage of improving the freedom of product design. However, more efforts and researches need to be made in order to implement a narrow bezel in an existing proposed differential display.

BRIEF SUMMARY

The present disclosure provides a display device including a display panel and a scan driver. The display panel has a display area for displaying an image. A scan driver is arranged in a non-display area of the display panel, and includes circuits for generating scan signals and a scan driver having signal lines for transferring signals and voltages for driving the circuits. Each of the circuits is composed of a plurality of stages and disposed along the display area, and the signal lines are disposed outside the circuits.

BRIEF DESCRIPTION OF THE SEVERAL VIEWS OF THE DRAWINGS

The accompany drawings, which are included to provide a further understanding of the disclosure and are incorporated on and constitute a part of this specification illustrate embodiments of the disclosure and together with the description serve to explain the principles of the disclosure.

DETAILED DESCRIPTION

Reference will now be made in detail embodiments of the disclosure examples of which are illustrated in the accompanying drawings.

Hereinafter, embodiments of the present disclosure will be described with reference to the accompanying drawings.

The present disclosure may be implemented as a TV, a video player, a personal computer (PC), a home theater, a smart phone, a smart watch, a virtual reality (VR) device, an augmented reality (AR) device, a vehicle display, etc., which are described in the following. In the following description, the present disclosure is implemented as a differentiated display device with a display panel which has is curved, for example a circular shape and an elliptical shape, rather than a quadrangular or rectangular shaped.

Figure 1:
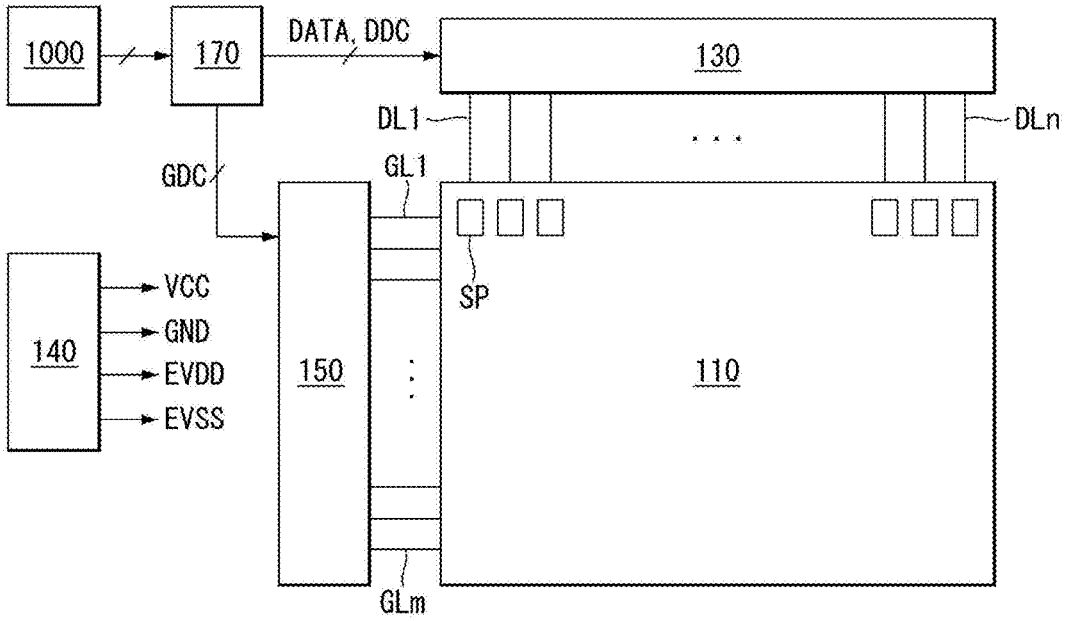
FIG. 1 is a block diagram schematically illustrating a display device according to an embodiment of the present disclosure.
Figure 2:
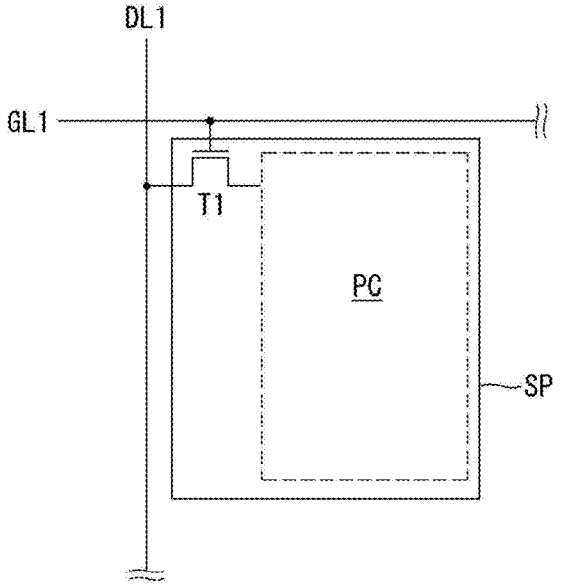
FIG. 2 is a diagram schematically illustrating a subpixel shown in FIG. 1.

FIG. 1 is a block diagram schematically illustrating a display device according to an embodiment of the present disclosure, and FIG. 2 is a diagram schematically illustrating a subpixel shown in FIG. 1.

As illustrated in FIG. 1, a display device basically includes a host system 1000, a timing controller 170, a data driver 130, a power supply 140, a scan driver 150, and a display panel 110.

The host system 1000 includes a System on Chip (SoC) with a scaler embedded therein to convert digital video data of an input image into a data signal in a format suitable to be displayed on the display panel, and outputs the data signal. The host system 1000 supplies various types of signals in addition to the data signal to the timing controller 170.

The timing controller 170 controls operation timings of the data driver 130 and the scan driver 150 based on a timing signal, such as a vertical synchronization signal, a horizontal synchronization signal, a data enable signal, and a main clock, received from the host system 1000. The timing controller 170 performs image processing (data compensation and the like) on a data signal received from the host system 1000, and supplies the data signal to the data driver 130.

The data driver 130 operates in response to a first driving signal DDC output from the timing controller 170. The data driver 130 converts a digital data signal DATA, received from the timing controller 170, into an analog data voltage, and outputs the analog data voltage. The data driver 130 supplies the data voltage to data lines DL1 to DLn of the display panel 110.

The scan driver 150 operates in response to a second driving signal GDC output from the timing controller 170. The scan driver 150 outputs a scan signal (or a gate signal) of a scan high voltage or a scan low voltage in response to the second driving signal GDC. The scan driver 150 may output scan signals in a sequential direction or in a reverse sequential direction. The scan driver 150 supplies scan signals to scan lines GL1 to GLm of the display panel 110.

The power supply 140 outputs a first power voltage EVDD and a second power voltage EVSS to drive the display panel 110, and outputs a third power voltage VCC and a fourth power voltage GND to drive the data driver 130. In addition, the power supply 140 generates and outputs a voltage, for example, a scan high voltage and a scan low voltage to be transferred to the scan driver 150, which is necessary to drive the display device.

The display panel 110 includes subpixels SP, the data lines DL1 to DLn connected to the subpixels SP, and the scan lines GL1 to GLm connected to the subpixels SP. The display panel 110 displays an image in response to a scan signal output from the scan driver 150 and a data voltage output from the data driver 130. The display panel 110 includes a lower substrate and an upper substrate. The subpixels SP are formed between the lower substrate and the upper substrate.

As illustrated in FIG. 2, one subpixel includes a transistor T1 connected to or formed at an overlapping location of the scan line GL1 and the data line DL1, and a pixel circuit PC operating in response to a data voltage supplied through the transistor T1.

The display panel 110 is implemented as a liquid crystal display panel or an organic light emitting display panel according to a configuration of a pixel circuit PC of the subpixels SP. When the display panel 110 is implemented as a liquid crystal display panel, the display panel 110 operates in a Twisted Nematic (TN) mode, a Vertical Alignment (VA) mode, an In Plane Switching (IPS) mode, a Fringe Field Switching (FFS) mode, or an Electrically Controlled Birefringence (ECB) mode. When the display panel 110 is implemented as an organic light emitting display panel, the display panel 110 operates in a Top-Emission method, a Bottom-Emission method, or a Dual-Emission method.

The above-described display panel of the display device may be selected not just as an organic light emitting display panel, but also as an electrophoretic display panel, a quantum dot display panel, a plasma display panel, or the like. In the following, a display device having an organic light emitting display panel will be described as an example for convenience of explanation. In addition, an example in which one pixel is composed of a red subpixel, a green subpixel, and a blue subpixel (RGB) is described in the following.

Figure 3:
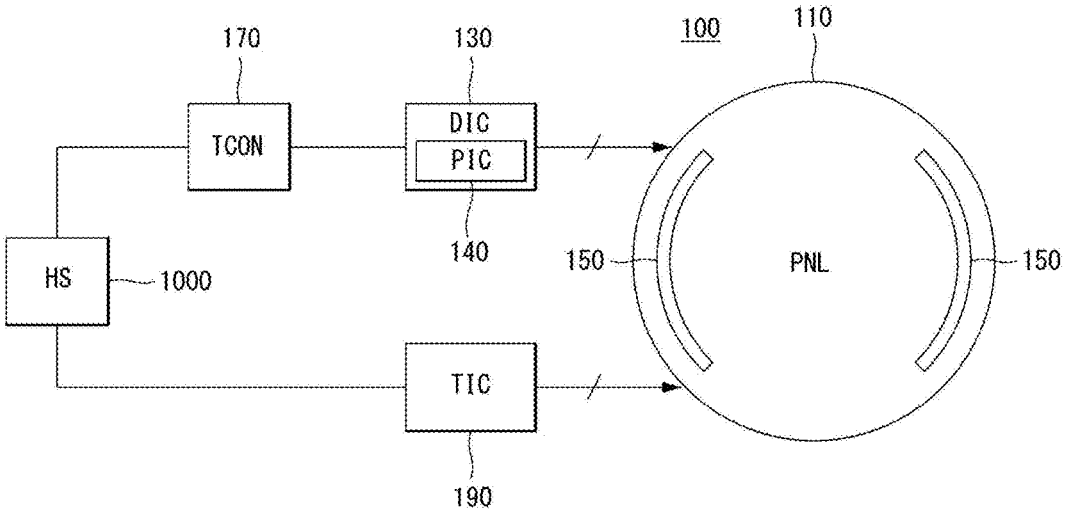
FIG. 3 is a block diagram schematically illustrating a differentiated display device according to an embodiment of the present disclosure.
Figure 4:
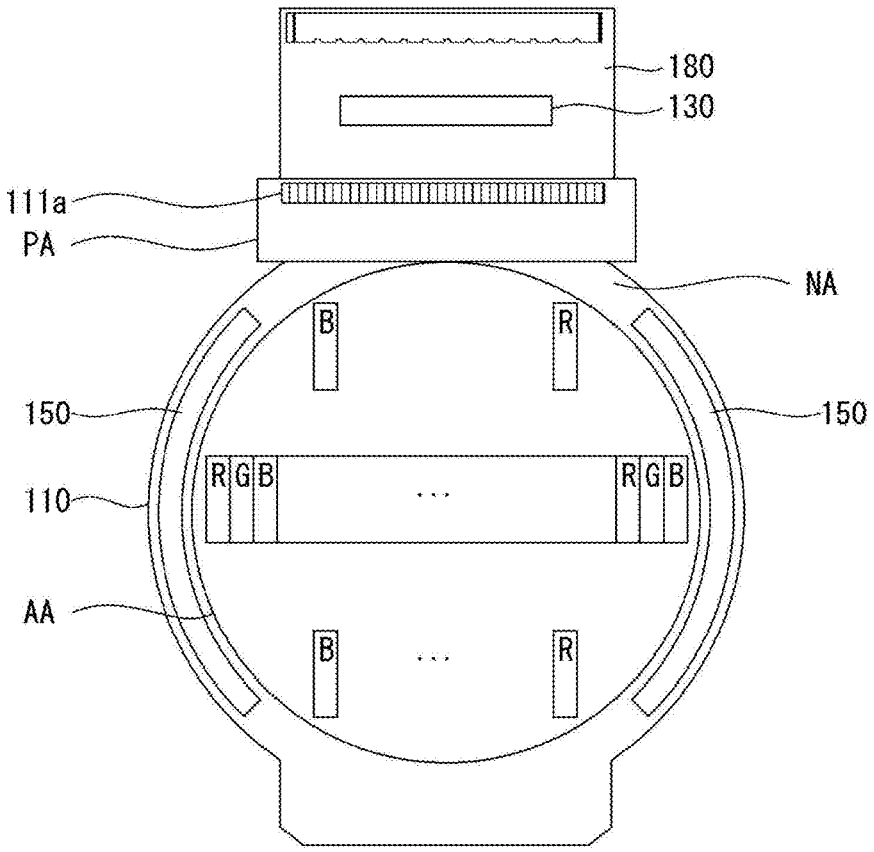
FIG. 4 is a plan view schematically illustrating a differentiated display panel shown in FIG. 3.

FIG. 3 is a block diagram schematically illustrating a differentiated display device according to an embodiment of the present disclosure, and FIG. 4 is a plan view schematically illustrating a differentiated display panel shown in FIG. 3.

As illustrated in FIG. 3, a differentiated display device 100 includes a host system 1000 HS, a timing controller 170 TCON, a data driver 130 DIC, a power supply 140 PIC, a scan driver 150, a display panel 110 PNL, and a touch driver 190 TIC.

For a less complex structure, some components of the differentiated display device 100 may be integrated. For example, the power supply 140 may be included in the data driver 130. However, it is merely an example, and there may be various implementations, for example, the timing controller 170 and the data driver 130 integrated into a single device. The scan driver 150 is embedded in the display panel 110 along with a pixel array. The scan driver 150 embedded in the display panel 110 is formed in a thin film transistor process in a Gate In Panel (GIP) method.

The differentiated display device 100 may have the touch driver 190 as a touch input means which helps a user to apply an input. In this case, the touch panel 110 includes touch sensors for sensing a touch location by the touch sensor 190 and outputting a value of a sensed location, and sensor lines for electrically connecting the touch sensors and the touch driver 190.

The touch driver 190 detects finger touch location information using a touch sensor which is implemented as a self capacitance type of a mutual capacitance type. The touch driver 190 transmits the detected finger touch location information to the host system 1000. The host system 1000 executes an application program associated with the touch location information received from the touch driver 190.

As illustrated in FIG. 4, the display panel 110 may be formed, for example, in a circular shape. However, the display panel 110 may be formed not just in a circular shape, but in any of various shapes, such as a polygonal shape and an elliptical shape. In a display area AA of the display panel 110, red, green, and blue subpixels (R,G,B) and touch sensors (not shown) are arranged.

A pad part 111*a* may be arranged in a pad area PA defined in upper and lower non-display areas (or a bezel area) NA of the display panel 110. The pad part 111*a* is depicted as being arranged only above the display area AA, but may be arranged below the display area AA.

The data driver 130 having a power supply is mounted in a flexible circuit board (film) 180. The flexible circuit board 180 is electrically connected to the pad part 111*a* by an anisotropic conductive film (ACF). On the flexible circuit board 180, other devices necessary to drive the display panel 110 may be mounted in addition to the data driver 130.

The scan driver 150 may be arranged in each of the left and right non-display areas NA of the display panel 110. The scan driver 150 outputs a scan signal for driving a switching transistor configured to control transmitting a data voltage, and an emission control signal for driving an emission control transistor configured to control an emission time of an organic light emitting diode (OLED).

Figure 5:
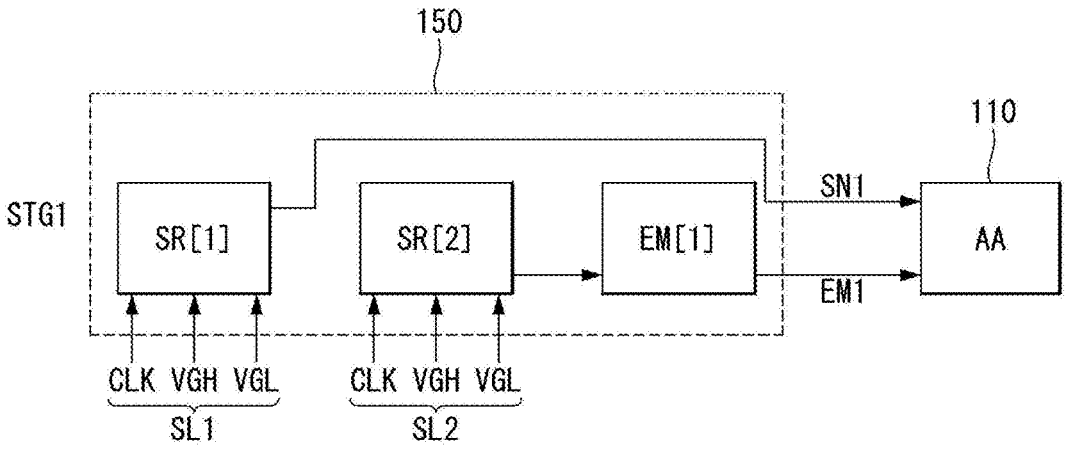
FIG. 5 is a diagram illustrating a first example of a scan driver.
Figure 6:
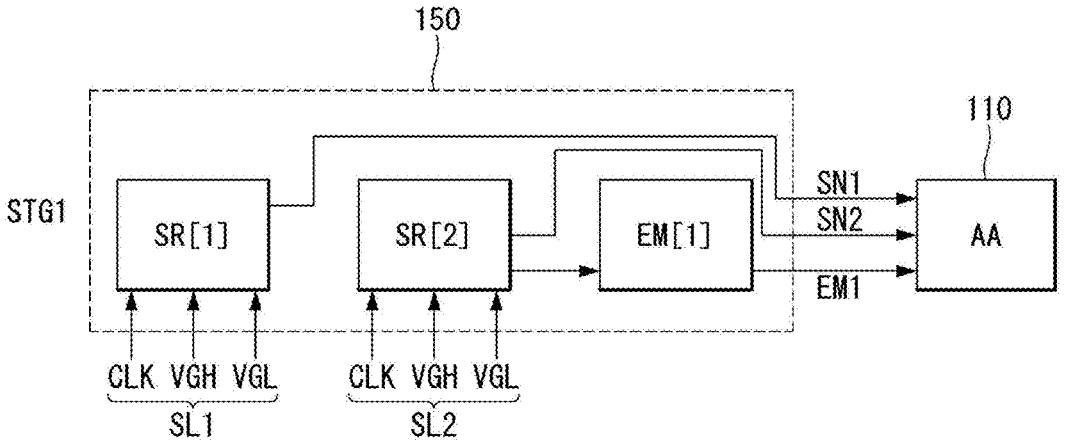
FIG. 6 is a diagram illustrating a second example of a scan driver.
Figure 7:
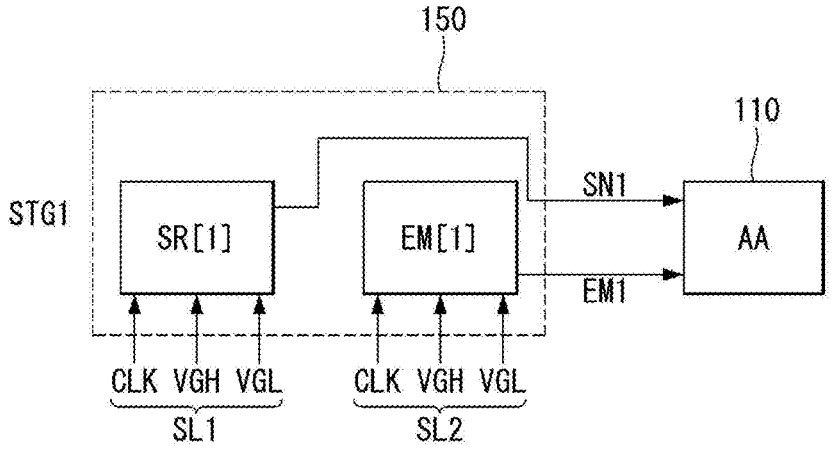
FIG. 7 is a diagram illustrating a third example of a scan driver.

FIG. 5 is a diagram illustrating a first example of a scan driver, FIG. 6 is a diagram illustrating a second example of a scan driver, and FIG. 7 is a diagram illustrating a third example of a scan driver.

As illustrated in FIG. 5, the scan driver 15 is composed of a plurality of stages, only one of which is illustrated in the figure. A first stage STG1 may include a first scan signal generator SR[1], a second scan signal generator SR[2], and a third scan signal generator EM[1], and non-illustrated second to n-th stages may each be configured in the same structure of the first stage STG1.

The first scan signal generator SR[1] operates based on a clock signal, a scan high voltage, and a scan low voltage supplied through a first signal line SL including a clock signal line CLK, a scan high voltage line VGH and a scan low voltage line VGL. The first scan signal generator SR[1] outputs a first scan signal SN1. The first scan signal SN1 output from the first scan signal generator SR[1] is supplied to the display panel 110.

The second scan signal generator SR[2] operates based on a clock signal, a scan high voltage, and a scan low voltage supplied through a second signal line SL2 including the clock signal line CLK, the scan high voltage line VGH, and the scan low voltage line. The second scan signal generator SR[2] outputs a second scan signal. The second scan signal output from the second scan signal generator SR[2] is supplied to the third scan signal generator EM[1].

The third scan signal generator EM[1] operates based on the second scan signal output from the second scan signal generator SR[1]. The third scan signal generator EM[1] may operate based on a clock signal, a scan high voltage, and a scan low voltage supplied through the second signal line SL2, as does the second scan signal generator SR[2], but aspects of the present disclosure are not limited thereto. The third scan signal generator EM[1] outputs a third scan signal EM1. The third scan signal EM1 output from the third scan signal generator EM[1] is supplied to the display panel 110.

Meanwhile, FIG. 5 and the following description describes an example in which circuits included in the scan driver 150 operate based on a signal or voltage supplied through the clock signal line CLK, the scan high voltage line VGH, or the scan low voltage line VGL, but this is merely exemplary, and different signals or voltages may be required to drive the circuits according to configuration of the circuits.

As illustrated in FIG. 6, the scan driver 150 is composed of a plurality of stages. A first stage STG1 may include a first scan signal generator SR[1], a second scan signal generator SR[2], and a third scan signal generator EM[1], and non-illustrated second to n-th stages may be configured in the same structure of the first stage STG1.

The first scan signal generator SR[1] operates based on a clock signal, a scan high voltage, and a scan low voltage supplied through a first signal line SL (a first signal line group) including a clock signal line CLK, a scan high voltage line VGH, and a scan low voltage line VGL. The first scan signal generator SR[1] outputs a first scan signal SN1. The first scan signal SN1 output from the first scan signal generator SR[1] is supplied to the display panel 110.

The second scan signal generator SR[2] operates based on a clock signal, a scan high voltage, and a scan low voltage supplied through a second signal line SL2 including the clock signal line CLK, the scan high voltage line VGH, and the scan low voltage line VGL. The second scan signal generator SR[2] outputs a second scan signal SN2. The second scan signal SN2 output from the second scan signal generator SR2 is supplied to the display panel 110. In addition, the second scan signal SN2 output from the second scan signal generator SR[2] is supplied to a third scan signal generator EM[1].

The third scan signal generator EM[1] operates based on the second scan signal SN2 output from the second scan signal generator SR[2]. The third scan signal generator EM[1] may operate based on a clock signal, a scan high voltage, and a scan low voltage supplied through the second signal line SL2, as does the second scan signal generator SR[2], but aspects of the present disclosure are not limited thereto. The third scan signal generator EM[1] outputs a third scan signal EM1. The third scan signal EM1 output from the third scan signal generator EM[1] is supplied to the display panel 110.

As illustrated in FIG. 7, the scan driver 150 is composed of a plurality of stages. A first stage STG1 may include a first scan signal generator SR[1] and a third scan signal generator EM[1], and non-illustrated second to n-th stages may be configured in the same structure of the first stage STG1.

The first scan signal generator SR[1] operates based on a clock signal, a scan high voltage, and a scan low voltage supplied through a first signal line SL including a clock signal line CLK, a scan high voltage line VGH, and a scan low voltage line VGL. The first scan signal generator SR[1] outputs a first scan signal SN1. The first scan signal SN1 output from the first scan signal generator SR[1] is supplied to the display panel 110.

The third scan signal generator EM[1] may operate based on a clock signal, a scan high voltage, and a scan low voltage supplied through a second signal line SL2 including a clock signal line CLK, a scan high voltage line VGH, a scan low voltage line VGL, etc. The third scan signal generator EM[1] outputs a third scan signal EM1. The third scan signal EM1 output from the third scan signal generator EM[1] is supplied to the display panel 110.

The third scan signal EM1 output from the third scan signal generator EM[1] corresponds to a signal for driving an emission control transistor disposed on the display panel 110. Thus, the third scan signal generator EM[1] may be defined as an emission control signal generator, and the third scan signal EM1 may be defined as an emission control signal.

As described above with reference to FIGS. 5 to 7, the scan driver 150 may be implemented in various forms in response to a circuit and operation of subpixels included in the display panel. In the following, the present disclosure having a structure shown in FIG. 5 will be described as an example.

Figure 8:
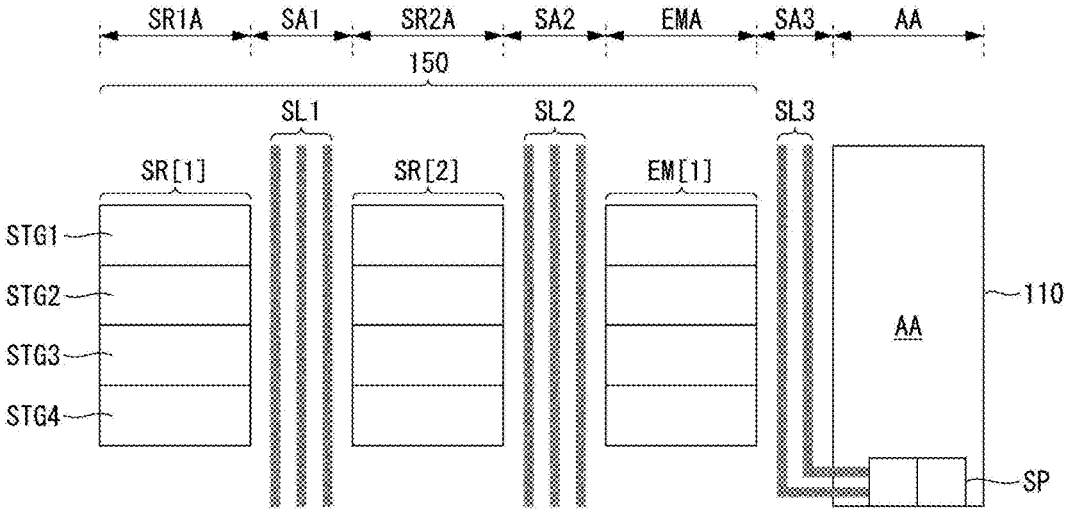
FIG. 8 is a diagram illustrating exemplary arrangement of a scan driver implemented in a non-display area of an existing rectangular display panel.
Figure 9:
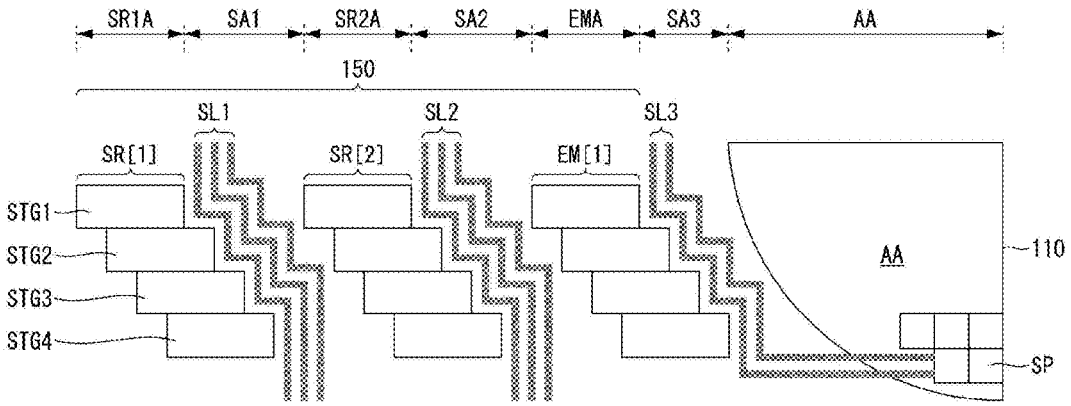
FIG. 9 is a diagram illustrating exemplary arrangement of a scan driver implemented in a non-display area of a differentiated display panel according to a comparative example.

FIG. 8 is a diagram illustrating exemplary arrangement of a scan driver implemented in a non-display area of an existing rectangular display panel, and FIG. 9 is a diagram illustrating exemplary arrangement of a scan driver implemented in a non-display area of a differentiated display panel according to a comparative example.

As illustrated in FIGS. 8 and 9, each of the existing rectangular display panel 110 and the differentiated display panel 110 according to the comparative example includes a scan driver 150 implemented in non-display areas SR1A, SA1, SR2A, SA2, EMA, and SA3.

The scan driver 150 includes circuits such as first to fourth stages STG1 to STG4, and lines such as first and second signal lines SL1 and SL2. Each of the first to fourth stages STG1 to STG4 includes a first scan signal generator SR[1], a second scan signal generator SR[2], and a third scan signal generator EM[1].

The first scan signal generator SR[1] is arranged most distal from a display area AA, and the third scan signal generator EM[1] is arranged closest to the display area AA, and the second scan signal generator SR[2] is arranged between the third scan signal generator EM[1] and the first scan signal generator SR[1]. The first scan signal generator SR[1], the second scan signal generator SR[2], and the third scan signal generator EM[1] are arranged in a distributed form with a space in which the first and second signal lines SL1 and SL2 are able to be arranged.

The first signal line SL1 is arranged between the first scan signal generator SR[1] and the second scan signal generator SR[2], and the second signal line SL2 is arranged between the second scan signal generator SR[2] and the third scan signal generator EM[1], and a third signal line SL3 is arranged between the third scan signal generator EM[1] and the display area AA. The third signal line SL3 (a third signal line group) is composed of an inspection signal lines used to inspect subpixels SP in the display area AA. The third signal line SL3 may be omitted according to a manufacturing method of the display panel 110.

As found in comparison between the scan drivers 150 arranged in the existing rectangular display panel 110 of FIG. 8 and in the differentiated display panel 110 according to the comparative example in FIG. 9, there is difference regarding arrangement of the first to fourth stages STG1 to STG4 and the first to third signal lines SL1 to SL3. In the scan driver of FIG. 8, the first to fourth stages STG1 to STG4 and the first to third signal lines SL1 to SL3 are arranged in a straight line. On the contrary, in the scan driver 150 of FIG. 9, the first to fourth stages STG1 to STG4 and the first to third signal lines SL1 to SL3 are arranged in a stair form (microscopically in a stair form) or a curved form (macroscopically in a curved form).

In the comparative example, the first to fourth stages STG1 to STG4 and the first to third signal lines SL1 to SL3 included in the scan driver 150 are arranged in a stair form or a curved form to correspond to the shape of the differentiated display panel 110. However, the comparative example shows the case where, the first to fourth stages STG1 to STG4 and the first to third signal lines SL1 to SL3 are changed into a stair form or a curved form while maintaining the existing arrangement structure.

In this structure, the scan driver 150 of the comparative example is able to be implemented to correspond to the shape of the differentiated display panel 110 but it is difficult to reduce the size of the bezel area. Thus, the structure is changed into the following embodiment.

Figure 10:
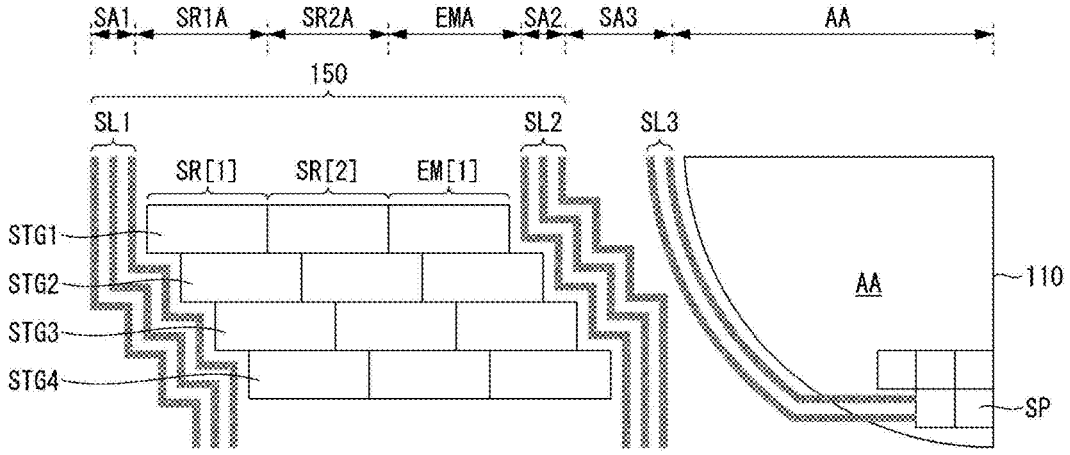
FIG. 10 is a diagram illustrating exemplary arrangement of a scan driver and signal lines implemented in a non-display area of a differentiated display panel according to an embodiment of the present disclosure.
Figure 11A:
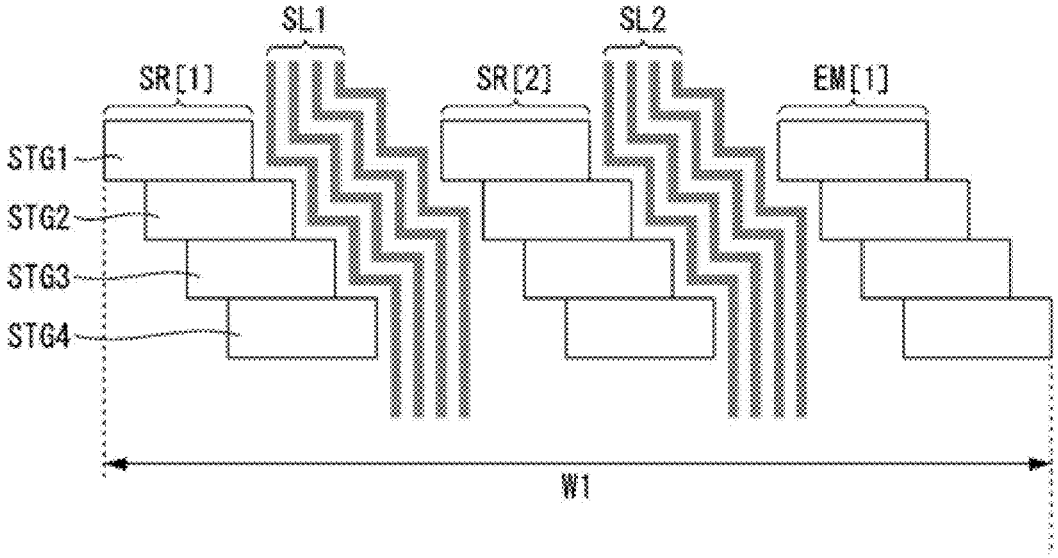
FIG. 11A and FIG. 11B are diagrams illustrating differences and effects between arrangement of a scan driver in a comparative example and arrangement of a scan driver in an exemplary example.
Figure 11B:
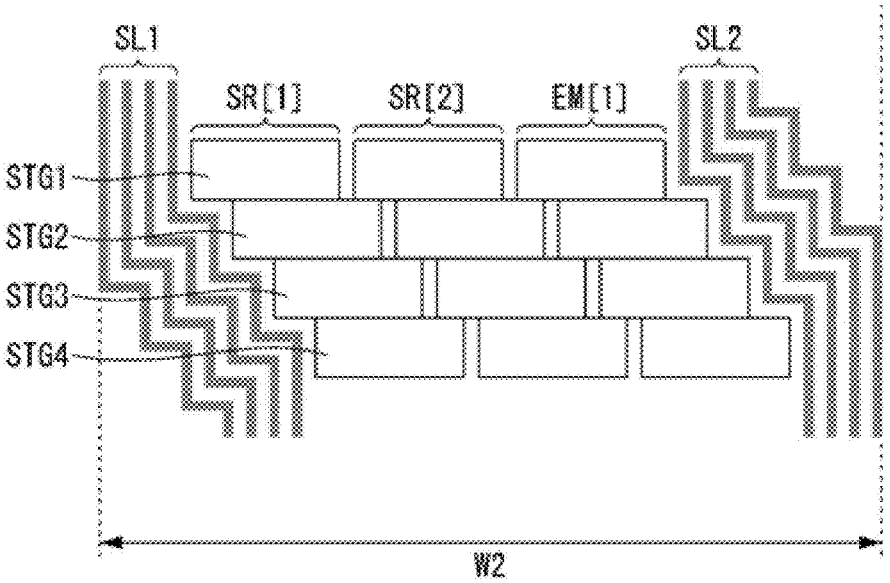
Figure 12A:
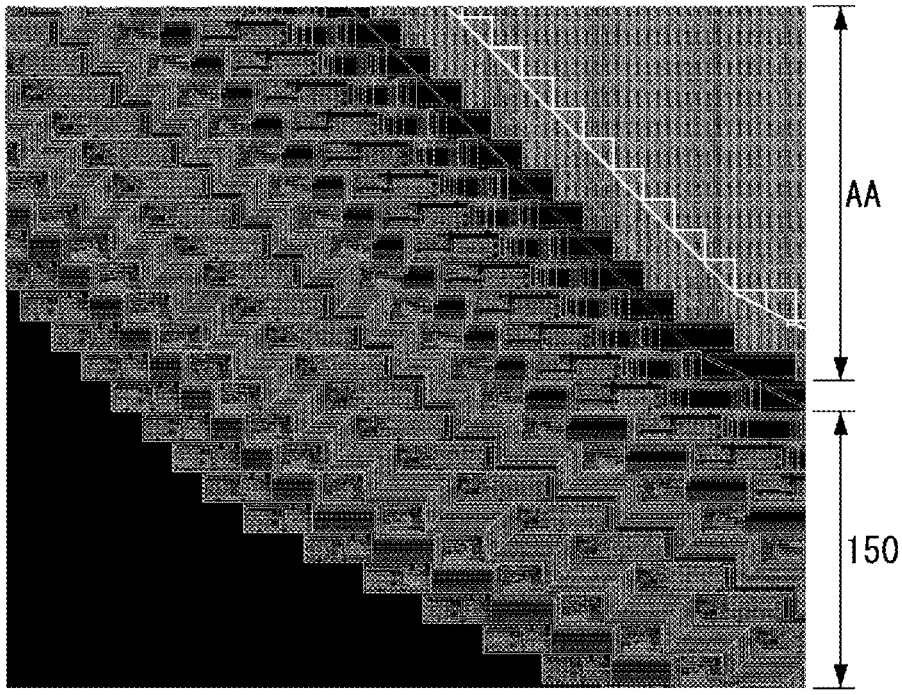
FIG. 12A and FIG. 12B are diagrams illustrating respective layouts of a comparative example and an exemplary example.
Figure 12B:
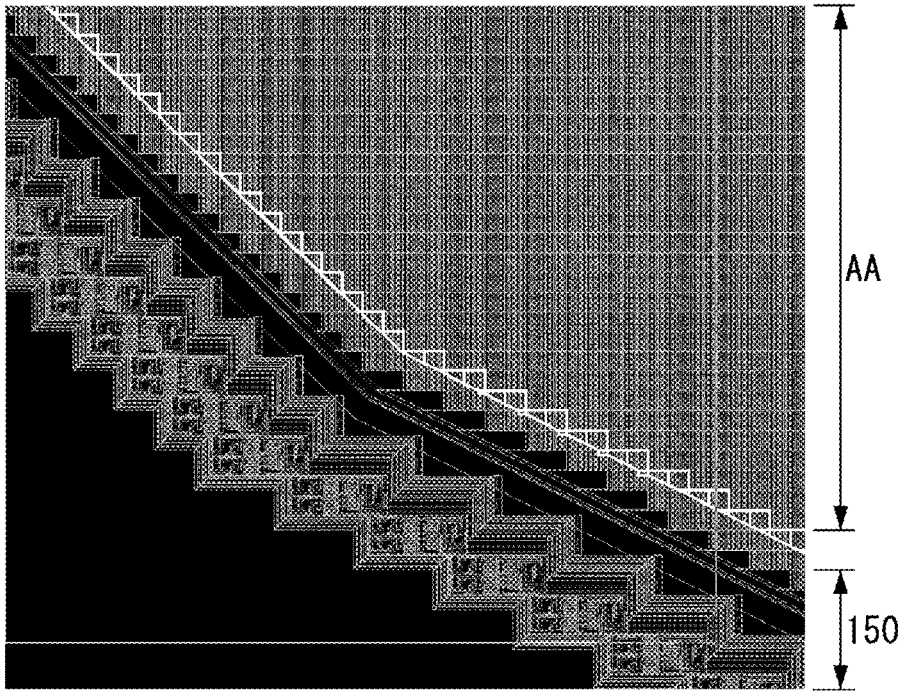

FIG. 10 is a diagram illustrating exemplary arrangement of a scan driver and signal lines implemented in a non-display area of a differentiated display panel according to an embodiment of the present disclosure, FIG. 11A and FIG. 11B are diagrams illustrating differences and effects between arrangement of a scan driver in the comparative example and arrangement of a scan driver in the embodiment of the present disclosure, and FIG. 12A and FIG. 12B are diagrams illustrating layouts of the comparative example and the embodiment of the present disclosure.

As illustrated in FIG. 10, the differentiated display panel 110 according to an embodiment of the present disclosure includes a scan driver 150 implemented in non-display areas SA1, SR1A, SR2A, EMA, SA2, and SA3.

The scan driver 150 includes circuits such as first to fourth stages STG1 to STG4, and lines such as first and second signal lines SL1 and SL2. Each of the first to fourth stages STG1 to STG4 includes a first scan signal generator SR[1], a second scan signal generator SR[2], and a third scan signal generator EM[1].

The first scan signal generator SR[1] is arranged most distal from a display area AA, and the third scan signal generator EM[1] is arranged closest to the display area AA, and the second scan signal generator SR[2] is arranged between the third scan signal generator EM[1] and the first scan signal generator SR[1]. The first scan signal generator SR[1], the second scan signal generator SR[1], and the third scan signal generator EM[1] are arranged densely to an extent where there is no space for the first and second signal lines SL1 and SL2 to be arranged.

The first signal line SL1 (the first signal line group) is arranged in one side of the first scan signal generator SR[1]. One side of the first scan signal generator Sr[1] corresponds to an outside of the scan driver 150 and an area close to an edge of the display panel 110. The second signal line SL2 (a second signal line group) is arranged in the other side of the third scan signal generator EM[1]. The other side of the third scan signal generator EM[1] corresponds to an inside of the scan driver 150 and an area closest to the display area AA of the display panel 110.

The third signal line SL3 (a third signal line group) is arranged between the second signal line SL2 and the display area AA. The third signal line SL3 is composed of inspection signal lines which are arranged closest to the display area AA and which are used to inspect subpixels SP of the display area AA. The third signal line SL3 may be omitted depending on a manufacturing method of the display panel 110.

Meanwhile, the third signal line SL3 is arranged in a curved form along the display area AA, but it may be arranged in a stair form considering the arrangement of the second signal line SL2.

As the two scan signal generators SR[1] and SR[2], and one third scan signal generator EM[1], and the first to third signal lines SL1 to SL3 are arranged as above, the non-display area SA1, SR1A, SR2A, EMA, SA2, and SA3 may be defined as below. SA1 is an area in which the first signal line SL1 is arranged, SR1A is an area in which the first scan signal generator SR[1] is arranged, SR2A is an area in which the second scan signal generator SR[2] is arranged, EMA is an area in which the third scan signal generator EM[1] is arranged, SA2 is an area in which the second signal line SL2 is arranged, and SA3 is an area in which the third signal line SL3 is arranged. As such, it is possible to classify the non-display area SA1, SR1A, SR2A, EMA, SA2, and SA3 into multiple areas because each of the circuits SR[1], SR[2], and EM[1] each is able to be arranged in a block form according to an area.

At least some from among the first to fourth stages STG1 to STG4 and the first and second signal lines SL1 and SL2 included in the scan driver 150 are arranged in a stair form (microscopically in a stair form) or a curved form (macroscopically in a curved form) along the shape of the display area AA.

In the drawing, a stair-like step is formed between the first stage STG1 and the second stage STG2, between the second stage STG2 and the third stage STG3, and between the third stage STG3 and the fourth stage STG4. However, it is merely exemplary, and a stair-like step may be formed at least every two stages, not every one stage. In other words, there may be stages having no stair-like step.

In an exemplary example of the present disclosure, the first scan signal generator SR[1], the second scan signal generator SR[2], and the third scan signal generator EM[1]

included in the scan driver 150 are arranged adjacent to each other. In addition, the first signal line SL1 is arranged on one side to the first scan signal generator SR[1], the second signal line SL2 is arranged on the other side to the third scan signal generator EM[1]. In summary, in the exemplary example, circuits included in the scan driver 150 are arranged adjacent to each other and instead lines existing between the circuits are arranged outside the circuits. That is, lines do not exist between the circuits.

As illustrated in FIG. 11A, as the first to fourth stages STG1 to STG4 has a stair-like arrangement structure, the first and second signal lines SL1 and SL2 have a stair-like arrangement structure as well. According to the structure of the comparative example, there are lines SL1 and SL2 between the circuits SR[1], SR[2], and EM[1] included in the scan driver 150.

As illustrated in FIG. 11B, as the first to fourth stages STG1 to STG4 have a stair-like arrangement structure, the first and second signal lines SL1 and SL2 have a stair-like arrangement structure as well. According to the structure of the exemplary example, there is no lines SL1 and SL2 between the circuits SR[1], SR[2], and EM[1] included in the scan driver 150.

If a differentiated display panel is designed based on the structure of the comparative example shown in FIG. 11A, the differentiated display panel will be designed as in FIG. 12A. On the contrary, if a differentiated display panel is designed based on the structure of the exemplary example shown in FIG. 11B, the differentiated display panel will be designed as in FIG. 12B.

In the drawings of the comparative example and the exemplary example, circuits and lines related to the scan driver 150 formed in a differentiated display panel are briefly illustrated and described. However, the circuits SR[1], SR[2], and EM[1] included in the first to fourth stages STG1 to STG4 are connected not just to the first and second signal lines SL1 and SL2, but to output lines for outputting signals generated in the circuits SR[1], SR[2], and EM[1]. In addition, the circuits SR[1], SR[2], and EM[1] included in the first to fourth stages STG1 to STG4 may be connected to connection lines (or jumping lines) (e.g., lines which help connection to scan lines) for transferring a carry signal (including a scan signal) or a signal necessary for controlling operation of an adjacent circuit.

However, according to the structure of the comparative example, when the lines SL1 and SL2 are bent corresponding to stair-type arrangement of the circuits SR[1], SR[2], and EM[1], there are many constraints. For example, the first signal line SL1 needs to be spaced apart from the first scan signal generator SR[1] and the second scan signal generator SR[2] arranged on both sides of the first signal line SL1. For this reason, the bezel area increases. This is the same case with the second signal line SL2. Thus, lines need to be arranged between circuits in the comparative example, and this causes a challenge to design a layout.

On the contrary, according to the structure of the exemplary example, it is possible to solve constraints which occur in other cases in addition to the case where the lines SL1 and SL2 are bent corresponding to stair-type arrangement of the circuits SR[1], SR[2], and EM[1]. For example, the first signal line SL1 needs to be arranged with a distance only from the first scan signal generator SR[1], and the second signal line SL2 needs to be arranged with a distance only from the second scan signal generator SR[2]. Thus, since lines are arranged outside the circuits, it is possible to considerably address the challenge in designing a layout.

In addition, according to the structure of the exemplary example, it is not necessary to arrange the lines SL1 and SL2 to correspond to the stair-type arrangement of the circuits SR[1], SR[2], and EM[1], thereby increasing the freedom of design. In addition, according to the structure of the exemplary example, the bezel area may decrease, and thus, an extra space obtained thereby may be used for other purposes.

In addition, according to the structure of the exemplary example, a length of a line for electrical connection to output lines or connection lines may be reduced, and thus, it is possible to prevent unnecessary increase in resistance. In addition, according to the structure of the exemplary example, occurrence of an overlapping section of different lines may be minimized, and thus, it is possible to improve a parasite capacitor, an RC drop (a voltage drop by resistance or a capacitor component), signal delay, etc.

Figure 13:
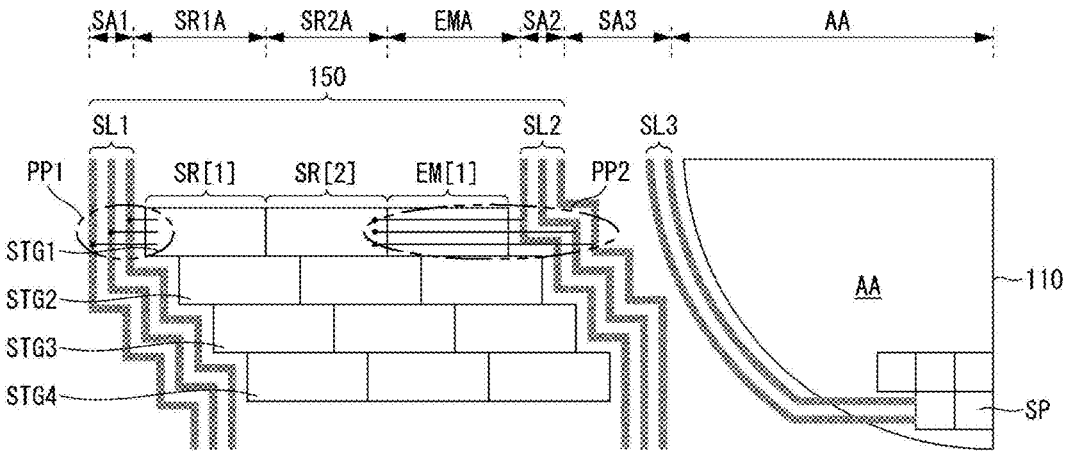
FIG. 13 is a plan view showing a connection relationship between a circuit and a signal line to achieve the structure shown in FIG. 10.
Figure 14:
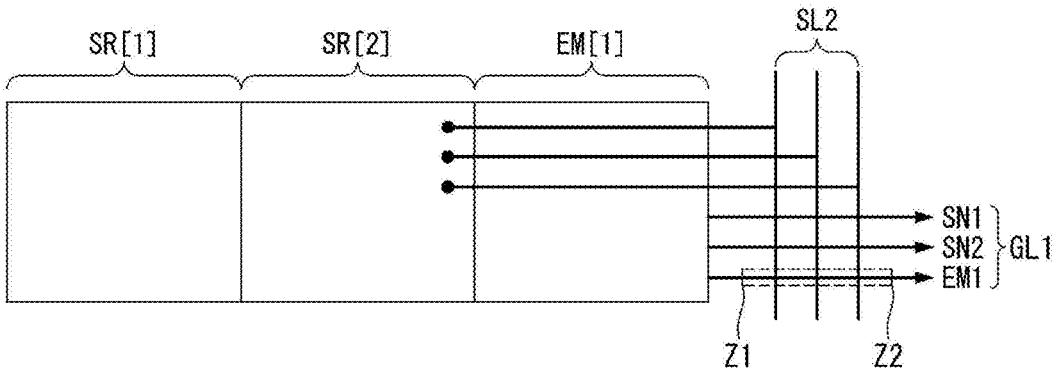
FIG. 14 is a diagram illustrating a part of FIG. 13.
Figure 15:
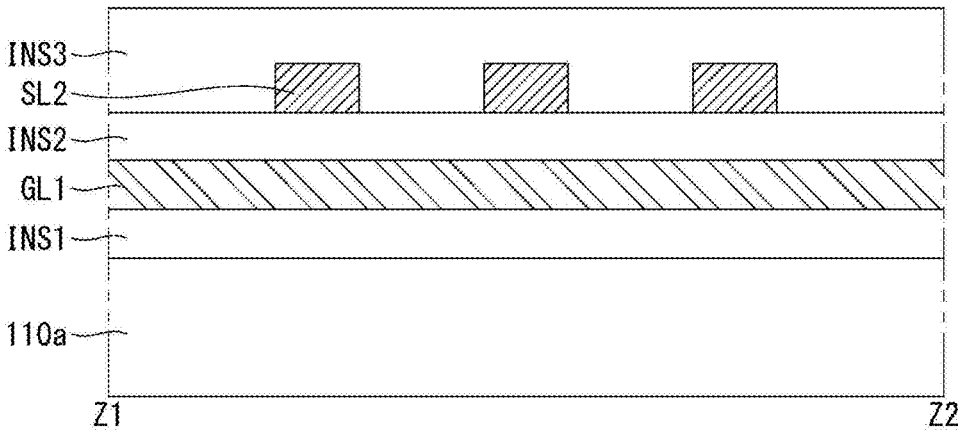
FIGS. 15 and 16 are cross-sectional views showing a connection relationship between a circuit and a signal line in a Z1-Z2 area.
Figure 16:
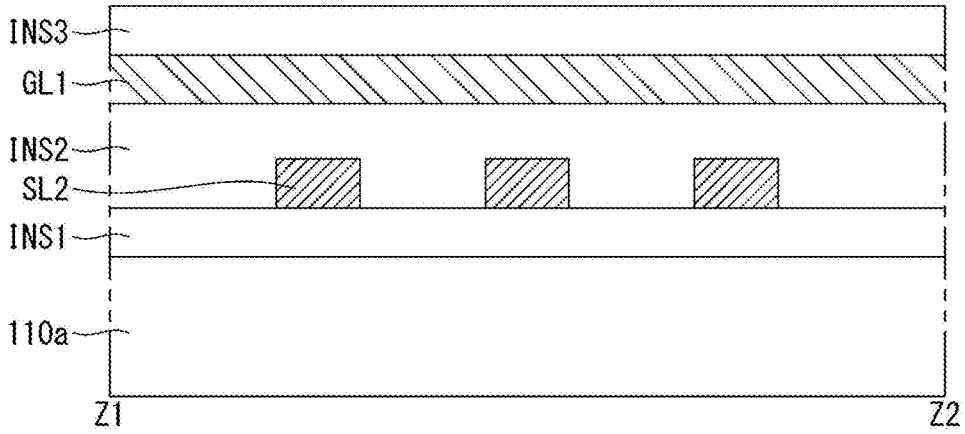

FIG. 13 is a plan view showing a connection relationship between a circuit and a signal line to achieve the structure shown in FIG. 10, FIG. 14 is a diagram illustrating a part of FIG. 13, and FIGS. 15 and 16 are cross-sectional views showing a connection relationship between a circuit and a signal line in a Z1-Z2 area.

As indicated as "PP1" and "PP2" in FIG. 13, the first signal line SL1 may be electrically connected to the adjacent first scan signal generator SR[1], and the second signal line SL2 may be electrically connected to the second scan signal generator SR[2]. Horizontally arranged lines like "PP1" and "PP2" are defined as connection lines (or jumping lines).

Connection to a direct adjacent circuit, such as the first signal line SL1, does not cause a problem, Thus, an example in which connection to a relatively far circuit, such as the second signal line SL2, is required will be described in the following.

As illustrated in FIGS. 13 and 14, the second signal line SL2 is electrically connected to the second scan signal generator SR[2] over the third scan signal generator EM[1]. That is, the second signal line SL2 needs to be connected to a circuit which is relatively far compared to the first signal line SL1, and thus, connection lines such as PP2 are required.

"SN1" is a first scan signal output from the first scan signal generator SR[1], "SR2" is a second scan signal output from the second scan signal generator SR[2], and "EM1" is an emission control signal output from the third scan signal generator EM[1]. The first scan signal SN1, the second scan signal SN2, and the third scan signal EM1 may be transferred to the display panel through the first scan line GL1 including 1*a*, 1*b*, and 1*c* scan lines.

The second signal line SL2 is vertically arranged to cross the first scan line GL1, but the second signal line and the first scan line GL1 are arranged on different layers with at least one insulating layer therebetween.

As illustrated in FIGS. 14 and 15, a first insulating layer INS1 may be disposed on a first substrate 110*a*. The first scan line GL1 may be horizontally arranged on the first insulating layer INS1. A second insulating layer INS2 may be disposed on the first insulating layer INS1 to cover the first scan line GL1. A second signal line SL2 may be vertically arranged on the second insulating layer INS2. A third insulating layer INS3 may be disposed on the second insulating layer INS2 to cover the second signal line SL2.

As in the above example, the first scan line GL1 and the second signal line SL2 may be disposed on different layers with at least one insulating layer, such as the second insulating layer INS2, therebetween while having a section in which the first scan line GL1 and the second signal line SL2 cross each other. For example, the first scan line GL1 may be implemented by a first metal layer which is formed of the same material of gate electrodes of transistors included in subpixels of the display area and which is disposed on the same layer of the gate electrodes of the transistors. In addition, the second signal line SL2 may be implemented by a second metal layer which is formed of the same material of source drain electrodes of the transistors included in the subpixels of the display area and which is disposed on the same layer of the source drain electrodes of the transistors.

As illustrated in FIGS. 14 and 16, the first insulating layer INS1 may be disposed on the first substrate 110*a*. The second signal line SL2 may be vertically arranged on the first insulating layer INS1. The second insulating layer INS2 may be disposed on the first insulating layer INS1 to cover the second signal line SL1. The first scan line GL1 may be horizontally arranged on the second insulating layer INS2. The third insulating layer INS3 may be disposed on the second insulating layer INS2 to cover the first scan line GL1.

As in the above example, the second signal line SL2 and the first scan line GL1 may be disposed on different layers with at least one insulating layer, such as the second insulating layer INS2, therebetween while having a section in which the second signal line SL2 and the first scan line GL1 cross each other. For example, the second signal line S12 may be implemented by a third metal layer which is formed of the same material of a light shielding layer for preventing an external light from influencing semiconductor layers of transistors included in subpixels of the display area and which is disposed on the same layer as a layer on which the light shielding layer is disposed. In addition, the first scan line GL1 may be implemented by a first metal layer which is formed of the same material of gate electrodes of transistors included in subpixels of the display area and which is disposed on the same layer as a layer on which the gate electrodes of the transistors is disposed.

However, the interlayer structure described in FIGS. 15 and 16 are merely exemplary, and aspects of the present disclosure are not limited thereto and signal lines and connection lines may constitute other metal layers. For example, the connection lines may be connected by a fourth metal layer which is formed of the same material of source drain electrodes of transistors included in subpixels of the display area and which is disposed on a layer higher than the second metal layer.

In addition, in FIGS. 14 and 16, the second signal line SL2 arranged vertically and the second signal line vertically branched and horizontally arranged are disposed on the same layer. However, jumping lines such as a portion which is branched from the second signal line SL2 and arranged horizontally may be implemented by a metal layer disposed on a different layer. For example, the jumping lines may be implemented by a third metal layer which is formed of the same material of a light shielding layer for preventing an external light from influencing semiconductor layers of transistors included in subpixels of the display area and which is disposed on the same layer as a layer on which the light shield lay is disposed. In addition, although not described above, not just lines but also circuits of the scan drier are formed in the non-display area on the first substrate 110*a*.

As such, the present disclosure may address a challenge in designing a layout by arranging lines outside circuits of a scan driver when manufacturing a differentiated display device, and may implement a narrow bezel. In addition, the present disclosure may reduce an arrangement space when designing a layout of a scan driver, and increase the freedom of design to an extent where an extra space obtained thereby can be used for other purposes. In addition, the present disclosure may reduce a length of a line to thereby prevent unnecessary increase in resistance, and may minimize a section in which different lines overlap each other so that problems such as a parasite capacitor, RC drop, and signal delay can be solved.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A display device, comprising:

a display panel having a display area configured to display an image and having a curved display area in at least part of the display panel; and a scan driver disposed in a non-display area of the display panel, the scan driver including circuits configured to generate scan signals and signal lines configured to transfer signals and voltages to drive the circuits, each of the circuits including a plurality of stages disposed along the display area, wherein each of the plurality of stages includes:

a first scan signal generator configured to output a first scan signal, a second scan signal generator configured to output a second scan signal, and an emission control signal generator configured to output an emission control signal, wherein the signal lines include:

a first signal line connected to the first scan signal generator; and a second signal line connected to the second scan signal generator and the emission control signal generator, wherein the first signal line is disposed between the first scan signal generator and an edge of the display panel, and the second signal line is disposed between the emission control signal generator and the curved display area, wherein at least some of the plurality of stages are arranged in a stair form along the curved display area, and wherein at least some of the signal lines are arranged in the stair form along the plurality of stages.

2. The display device of claim 1, wherein the circuits are densely arranged.

3. The display device of claim 1, further comprising a third signal line disposed between the second signal line and the curved display area, wherein the third signal line is arranged in the stair form along the first and second signal lines or in a curved form along the display area.

4. The display device of claim 1, further comprising connection lines configured to provide electrical connection between the second signal line and the second scan signal generator, wherein the connection lines include a second metal layer disposed above a first metal layer that forms a scan line.

5. The display device of claim 1, further comprising connection lines configured to provide electrical connection between the second signal line and the second scan signal generator, wherein the connection lines include a third metal layer disposed below a first metal layer that forms a scan line.

6. The display device of claim 1, wherein the signal lines are arranged in one side periphery and a second side periphery of the circuits, and are arranged corresponding to lengths of the circuits.

7. The display device of claim 1, wherein the signal lines are not arranged between the circuits.

8. The display device of claim 1, further comprising connection lines electrically connected to the signal lines, wherein the signal lines and the connection lines are disposed on different layers.

* * * * *